United States Patent [19]

Buettner

[11] Patent Number: 4,638,125

[45] Date of Patent: Jan. 20, 1987

[54] HEARING AID WITH A HOUSING TO BE WORN BEHIND THE EAR

[75] Inventor: Gerhard Buettner, Grossenseebach, Fed. Rep. of Germany

[73] Assignee: Siemens Aktiengesellschaft, Berlin and Munich, Fed. Rep. of Germany

[21] Appl. No.: 628,797

[22] Filed: Jul. 9, 1984

[30] Foreign Application Priority Data

Sep. 21, 1983 [DE] Fed. Rep. of Germany ... 8327115[U]

[51] Int. Cl.[4] ..... H04R 25/00

[52] U.S. Cl. ..... 381/68.4; 381/68.7

[58] Field of Search ..... 179/107 H, 107 R, 107 E, 179/179, 112; 381/68, 69

[56] References Cited

U.S. PATENT DOCUMENTS

| | | | |
|---|---|---|---|
| 2,994,806 | 8/1961 | McLaughlin | 361/422 |
| 3,015,704 | 1/1962 | Behyner | 179/107 R |
| 3,465,107 | 9/1969 | Parthum | 179/107 R |
| 3,668,334 | 6/1972 | Schwake | 179/107 R |
| 3,688,052 | 8/1972 | Self et al. | 179/107 H |

FOREIGN PATENT DOCUMENTS

| | | | |
|---|---|---|---|
| 0027496 | 6/1980 | European Pat. Off. . | |
| 770594 | 2/1977 | Fed. Rep. of Germany . | |
| 2244391 | 4/1975 | France . | |
| 473524 | 7/1969 | Switzerland | 179/107 H |

OTHER PUBLICATIONS

"Hearing Instruments", Philips ad, vol. 31, No. 10, Oct. 1980.

*Primary Examiner*—Gene Z. Rubinson
*Assistant Examiner*—Danita R. Byrd
*Attorney, Agent, or Firm*—Hill, Van Santen, Steadman & Simpson

[57] ABSTRACT

A hearing aid has a behind-the-ear housing containing a microphone, an amplifier, a current source and an ear phone, and a group of regulators for controlling various operating characteristics and an acoustic coil. The regulators and the acoustic coil are insertable through an opening in the rear of the housing and are combined in a single unitary unit which can be attached to the amplifier. The precise orientation of the regulators and the coil with respect to each other is thus always the same and can be easily achieved during assembly. The necessary electrical separation between the parts is also guaranteed.

11 Claims, 6 Drawing Figures

HEARING AID WITH A HOUSING TO BE WORN BEHIND THE EAR

BACKGROUND OF THE INVENTION

1. Field of the Invention

The present invention relates to hearing aids of the type which are worn behind the ear.

2. Description of the Prior Art

Hearing aids are known in the art having a behind-the-ear housing in which components for amplification and matching of the aural signals to the nature and degree of the user's hearing impediment are contained. Such components generally consist of a microphone, an amplifier, a current source, an acoustic coil, an earphone, and regulators for adapting volume, timbre and amplifier characteristics such as automatic gain control (AGC) and peak cut-off (PC) to the user's needs.

In conventional hearing aid devices, battery contacts and, under certain conditions, an acoustic coil as well as the regulators are mounted on the mounting plate or circuit board for the amplifier and other associated components in order to determine the functioning of the device even before final assembly of the device with the housing. A problem in the art, particularly with respect to the regulators for matching and for gain control and frequency distribution, is that such regulators must be relatively precisely placed with respect to each other and with respect to the other components by means of particularly careful assembly in order to guarantee the necessary electrical separation by observing adequate tolerances. In hearing aids which are additionally equipped for receiving induction signals with an acoustic coil, additional mounting means must be provided for this component.

SUMMARY OF THE INVENTION

It is an object of the present invention to provide a hearing aid with a housing to be worn behind the ear having a plurality of regulators and an acoustic coil contained in the housing which is easy to assemble while simultaneously observing precise location of the components with respect to each other.

It is a further object of the present invention to provide such a hearing aid which has components arranged to save mounting space.

The above objects are inventively achieved in a hearing aid having a housing containing, among other components, a group of regulators and an acoustic coil. The regulators and the acoustic coil are combined in a single unitary mounting unit which can be attached to the hearing aid amplifier within the housing. By combining the regulators and the acoustic coil in a single unit which is connectable to the amplifier, the necessary spacing of these components with respect to each other remains constant without the necessity of undertaking special adjustment measures during assembly. Tolerances which unnecessarily occupy additional space can thus be eliminated because proper operation of the component is insured by the unitary element.

DESCRIPTION OF THE PREFERRED EMBODIMENTS

Figure 1:
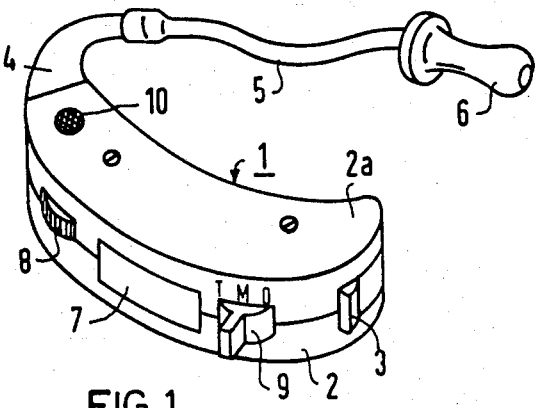
FIG. 1 is a perspective view of a hearing aid with a housing to be worn behind the ear constructed in accordance with the principles of the present invention.

A hearing aid 1 is shown in FIG. 1 having components therein arranged and mounted in accordance with the principles of the present invention. The hearing aid 1 has a housing comprised of two joined shells 2 and 2*a*. The housing has a battery drawer 3 at the lower portion, and has a crook at an upper portion by means of which the hearing aid 1 is worn behind the ear. The free end of the crook 4 is connected to a conduit 5 terminating in an earpiece 6 which can be inserted into the ear canal so that amplified acoustic signals proceed directly into the inner ear. A regulator wheel 8 for the volume is disposed above a locking flap 7, and a switch 9 is disposed below the flap 7 at the rear of the device, which assumes a convex curve.

Figure 2:
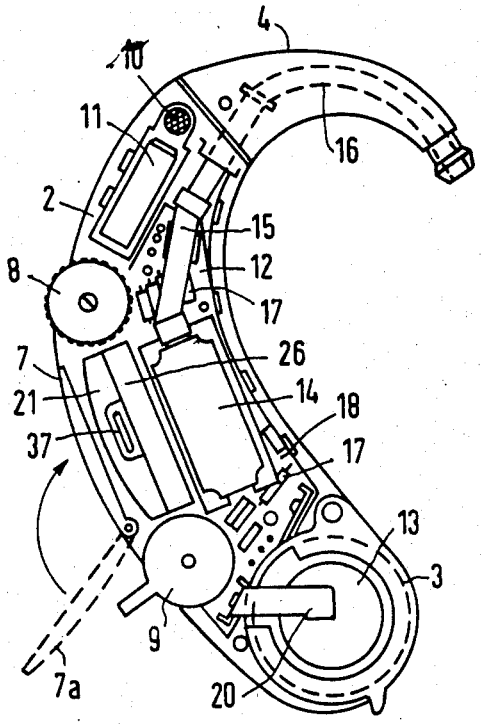
FIG. 2 is a plan view of the hearing aid shown in FIG. 1 with half of the housing removed showing the interior components.

The components contained in the interior of the hearing aid 1 are shown in detail in FIG. 2. The hearing aid 1 operates in a conventional manner with an aural signal entering the device through an opening 10 and proceeding to a microphone 11 wherein the signal is converted into electrical signals which are amplified in an amplifier 12 powered by means of a battery 13. The electrical signals are reconverted into aural signals in an earphone 14. The amplified signals proceed through a sound-conducting channel 15 connected to another channel 16 within the crook 4. The channel 16 is connected to the conduit 5 (not shown in FIG. 2).

The amplifier 12 has a number of components designated 17 which are attached to a mounting plate 18. A spring contact 20 together with a complimentary opposing contact (not visible in FIG. 2) are connected to the battery 13 for receiving power therefrom. In addition, the plate 18 carries a mounting unit 21 at its edge closest to the convex side of the housing 1. The mounting unit 21 contains regulators 22, 23, 24 and 25 and an acoustic coil 26 combined therein. The coil 26 can be switched on by means of the switch 9 in the position T shown in FIG. 1, the switch effecting connecting of the amplifier 12 to the microphone 11 when in the position M shown in FIG. 1. The hearing aid is switched off when the switch 9 is in the switch position O. The regulators 22 through 25 contained in the mounting unit 21 are accessible by opening the flat 7 (which is movable to the position 7a shown in dashed lines in FIG. 2) which exposes the regulators 22 through 25 permitting them to be set by means of their respective actuation elements 27, 28, 29 and 30 (shown in FIG. 3).

The regulator 22 functions for adjustment of peak cut-off (PC). As indicated by the direction of the screw slot of its actuation element 27 (which can be set with a screwdriver), this regulator is switched off in FIG. 3.

The regulator 23 serves for regulating automatic gain control for the amplifier 12 and may be set to a maximum amplification of 90 dB. As shown by the other numerals in FIG. 3, settings of 60 or 75 dB could also be selected.

Figure 3:
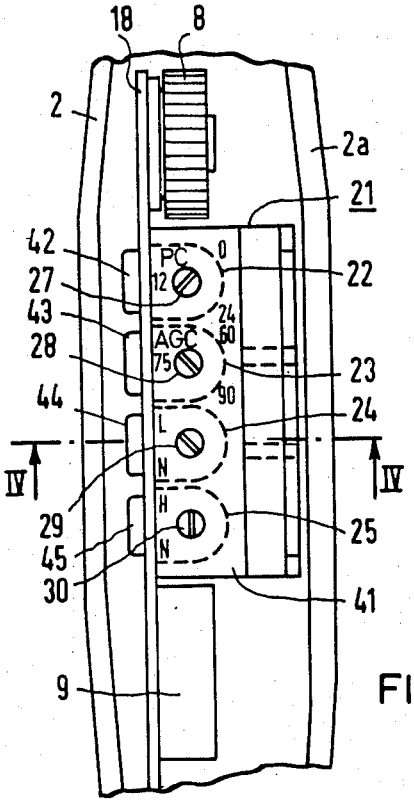
FIG. 3 is an enlarged detail of a portion of the rear of the device shown in FIG. 2.

The regulator 24 functions to control the transmission of lower frequencies in the amplifier 12. When the regulator 24 is set as shown in FIG. 3 at position L, transmission of lower frequencies is enhanced. Uniform transmission of all frequencies can be achieved at setting N, i.e., normal.

The regulator 25, which is switched off in the position shown in FIG. 3, functions to control transmission of high frequencies in the amplifier 12. When set to position H, transmission of higher frequencies is enhanced. Again, uniform trnasmission of all frequencies is achieved at setting N.

The mounting unit 21 has a unitary mounting plate 35 to which the regulators 22 through 25 and the acoustic coil 26 are attached. This component, shown separately in FIG. 5 in a side view, has recesses 50, 51, 52 and 53 into which the regulators 22 through 25 respectively fit. The unitary mounting plate 35 also has a projection 36 which is received in a complimentary shaped eyelet 37 formed in the acoustic coil component. The regulators 22 through 25 are disposed side by side along a curved surface corresponding to the rear of the housing.

Figure 4:
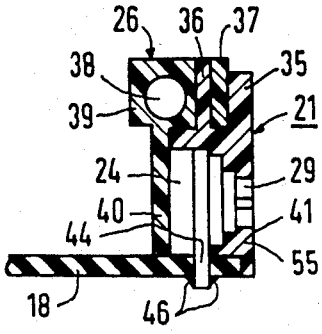
FIG. 4 is a sectional view taken along line IV—IV of FIG. 3 showing the unitary mounting plate constructed in accordance with the principles of the present invention.

As shown in FIG. 4, the winding 38 of the acoustic coil 26 is injected into a synthetic member 39 having a projection 40 as well as the eyelet 37. The projection 40 closes the openings 50 through 53 for the regulators 22 through 25 from the remaining mounting space of the amplifier. The opposite side of the openings is closed by the unitary mounting plate 35 itself. An upper portion 41 of the plate 35 forms one side of the receptacle for the regulators 22 through 25 at the side facing the viewer in FIG. 2. The mounting plate 18 for the amplifier 12 forms the other side, which is still open after assembly. Fastening of the unitary mounting plate 35, with the coil and regulators carried thereon, is achieved by means of clips 42, 43, 44 and 45 carried on the regulators 22 through 25 which project from the regulators after the regulators have been inserted into the plate 35. The clips 42 through 45 extend through the plate 18 and are soldered as indicated at 46 so as to simultaneously fasten the components and provide an electrical connection to the circuit for the amplifier 12.

Figure 5:
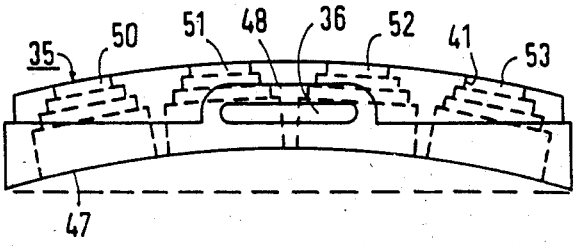
FIG. 5 is a side view of the unitary mounting plate constructed in accordance with the principles of the present invention.

Mechanical stabilization of the unitary mounting arrangement is achieved by the curvature of the projection 40, the curve indicated at 47 in FIG. 5, as well as by curvature of the plate 35. The plate 35 has an additional recess 48 in which the projection 36 which receives the eyelet 37 is disposed. The recess 48 has a shape matched to the eyelet 37. The receptacles 50, 51, 52 and 53 for the regulators 22 through 25 have shapes which are matched to the shapes of the regulators. The combined unit consisting of the unitary plate 35, the acoustic coil 26 and the regulators contained therein is already mechanically durable when assembled, and can be attached to the mounting plate 18 of the amplifier 12 as a single physical unit.

Figure 6:
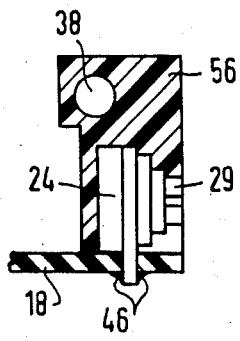
FIG. 6 is a sectional view of a second embodiment of a mounting plate constructed in accordance with the principles of the present invention.

Simplification and further mechanical stabilization of the assembly can be achieved in another embodiment shown in sectional view in FIG. 6, wherein the unitary mounting plate 35 and the synthetic member 39 shown in FIG. 4 are combined in a single component, referenced at 56 in FIG. 6. The portion of the plate 35 referenced at 55 in FIG. 4 is omitted in the embodiment shown in FIG. 6 to permit insertion of the regulators 22 through2 5 in their respective openings in the component 56 prior to covering the openings with the plate 18 during final assembly. This is in contrast to insertion of the regulators 22 through 25 from the curved side 47 shown in the embodiment of FIG. 5.

By combining the regulators 22 through 25 and the acoustic coil 26 in a single unit, the actuation elements 27 through 30 are always precisely aligned with the proper labeled regulator aperture so that additional alignment procedures are not required. In addition to being guided and supported at the solder locations 46, the regulators 22 through 25 are also guided and supported by the unitary mounting plate 35. Given actuation of the regulators by a screwdriver at the locations 27 through 30, the regulators thus cannot be dislocated or the solder locations 46 broken. Because the unit 21 is closed on all sides by electrically insulating material, the regulators 22 through 25 are not subject to the possibility of inadvertent contact with each other or with the surrounding electrically conductive components 17 of the amplifier 12, either in quiscent condition or upon energization. Because the regulator aperture 41 acts as a means for securing the regulators during soldering, the regulators 22 through 35 are automatically correctly adjusted relative to each other, so that subsequent adjustment means are not necessary. The acoustic coil 26 is secured to the unit 35 without the necessity of additional mounting structure which would otherwise have to be carried on the housing shell 2 or the amplifier 12. The eyelet 37 and the projection 36 are easily manufactured by injection molding. Final inspection of the amplifier 12 can be undertaken before incorporation in the housing shells 2 and 2*a*. The hearing aid constructed in accordance with the principles of the present invention is easy to service, because all functional components except the microphone 11 and the earphone 14 and the battery compartment 3 can be built-in and dismantled together with the amplifier 12.

Although modifications and changes may be suggested by those skilled in the art it is the intention of the inventor to embody within the patent warranted hereon all changes and modifications as reasonably and properly come within the scope of his contribution to the art.

The acoustic coil 26 is generally also known as telecoil becuase it is mostly used with hearing aids for receiving induction signals originating in telephone receivers, to improve the ability of hearing impaired persons to understand telephone calls.

I claim as my invention:

1. A hearing aid having a housing to be worn behind a user's ear, said housing containing a microphone, an amplifier, a current source and an acoustic coil and a plurality of regulators for controlling selected operating characteristics of said hearing aid, said regulators and said acoustic coil being mounted in combination in a single unit in said housing and attached to said amplifier, said unit having a first portion having a plurality of receptacles for respectively receiving said regulators and a second portion in which said acoustic coil is embedded and a projection carried on at least one of said first and second portions and an eyelet carried on the other of said first and second portions for receiving said projection therethrough for rigidly connecting said first and second portions.

2. A hearing aid as claimed in claim 1 wherein said regulators have actuation means thereon respectively extending through apertures in said first portion, said first portion having labels disposed adjacent said apertures identifying settings for said actuation means.

3. A hearing aid as claimed in claim 1 wherein said housing has a curved rear side and wherein said unit has a curved edge corresponding to the curvature said curved rear side of said housing.

4. A hearing aid as claimed in claim 1 wherein said unit comprises a single plastic element in which said acoustic coil is enclosed and having a plurality of receptacles for respectively receiving and retaining said regulators.

5. A hearing aid as claimed in claim 4 wherein said amplifier is mounted on a mounting plate having a plurality of openings therein and wherein said regulators in said receptacles each have projections extending through respective ones of said openings in said mounting plate, and wherein said projections of said regulators are soldered to said mounting plate.

6. A hearing aid having a housing to be worn behind a user's ear, said housing containing a microphone, an amplifier, a mounting plate on which said amplifier is mounted, said mounting plate having a plurality of slots therein, a current source and an acoustic coil and a plurality of regulators for controlling selected operating characteristics of said hearing aid, said regulators and said acoustic coil being mounted in combination in a single unit in said housing and attached to said amplifier, said unit having a synthetic member in which said acoustic coil is enclosed having first and second legs disposed at substantialy a right angle with respect to each other, and a regulator mounting element disposed such that said regulators are enclosed within said right angle of said legs of said synthetic member such that said regulators are enclosed on three sides and a fourth open side of each regulator is covered with said mounting plate of said amplifier, said regulators being inserted in respective ones of said slots therein.

7. A hearing aid comprising:

a housing to be worn behind a user's ear, said housing having an opening therein;

a mounting plate secured in said housing, said mounting plate having a plurality of slots therein;

a plurality of regulators for controlling selected operating characteristics of said hearing aid each having an actuation element and a projection, each said projection being inserted into one of said plurality of slots in said mounting plate;

a regulator mounting element having a plurality of recesses therein for respectively receiving said regulators; and an acoustic coil enclosed within said regulator mounting element such that said acoustic coil and said regulator mounting element form a single unit in said housing, said regulator mounting element being disposed on said mounting plate such that the respective actuation elements of said regulators are accessible through said opening of said housing, and said projections of said regulators being soldered in said slots of said mounting plate securing said regulator mounting element on said mounting plate.

8. A hearing aid as claimed in claim 7 further comprising means for rigidly connecting said acoustic coil and said regulator mounting element.

9. A hearing aid as claimed in claim 8 further comprising a member in which said acoustic coil is embedded and means for rigidly connecting said member and said regulator mounting element.

10. A hearing aid as claimed in claim 9, wherein said member in which said acoustic coil is embedded consists of plastic.

11. A hearing aid as claimed in claim 7 wherein said regulator mounting element consists of plastic.

* * * * *